US009738075B2

(12) United States Patent
Ohsumi et al.

(10) Patent No.: US 9,738,075 B2
(45) Date of Patent: Aug. 22, 2017

(54) LIQUID DISCHARGE HEAD AND METHOD OF MANUFACTURING THE SAME

(71) Applicant: CANON KABUSHIKI KAISHA, Tokyo (JP)

(72) Inventors: Masaki Ohsumi, Yokosuka (JP); Kenji Fujii, Yokohama (JP); Junichi Kobayashi, Ayase (JP); Ken Ikegame, Ebina (JP); Nobuhisa Tanahashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/839,487

(22) Filed: Aug. 28, 2015

(65) Prior Publication Data

US 2016/0059553 A1 Mar. 3, 2016

(30) Foreign Application Priority Data

Sep. 1, 2014 (JP) ..... 2014-176785

(51) Int. Cl.
*B41J 2/16* (2006.01)

(52) U.S. Cl.
CPC ..... *B41J 2/162* (2013.01); *B41J 2/1603* (2013.01); *B41J 2/1606* (2013.01); *B41J 2/1628* (2013.01); *B41J 2/1631* (2013.01); *B41J 2/1632* (2013.01); *B41J 2/1639* (2013.01)

(58) Field of Classification Search
CPC ..... B41J 2/162; B41J 2/1632; B41J 2/1603; B41J 2/1631; B41J 2/1606; B41J 2/1628; B41J 2/1639
See application file for complete search history.

(56) References Cited

U.S. PATENT DOCUMENTS 6,358,354 B1 * 3/2002 Patil ..... B41J 2/16 156/273.3
2002/0019483 A1 * 2/2002 Sato ..... C08G 65/007 525/100
2004/0110077 A1 * 6/2004 Yachi ..... G03G 9/08797 430/108.6
2005/0008794 A1 * 1/2005 Graczyk ..... B41M 5/502 428/32.24
2005/0026089 A1 * 2/2005 Ogawa ..... B82Y 30/00 430/405
2005/0245633 A1 * 11/2005 Soutar ..... B41J 2/1606 522/83
2006/0083871 A1 * 4/2006 Chen ..... B41M 5/502 428/32.34
2007/0229575 A1 * 10/2007 Graham ..... B41J 2/14024 347/20
2011/0072967 A1 * 3/2011 Wood ..... C08B 37/0012 95/141
2012/0267342 A1 * 10/2012 Furusawa ..... B41J 2/1603 216/41

FOREIGN PATENT DOCUMENTS

JP 2007-518587 A 7/2007

* cited by examiner

*Primary Examiner* — Matthew Luu
*Assistant Examiner* — Patrick King
(74) *Attorney, Agent, or Firm* — Canon U.S.A., Inc. IP Division

(57) ABSTRACT

A liquid discharge head provided with a member having discharge ports formed configured to discharge liquid thereon, wherein a discharge port surface of the member having discharge ports arrayed thereon includes fumed silica.

5 Claims, 6 Drawing Sheets

LIQUID DISCHARGE HEAD AND METHOD OF MANUFACTURING THE SAME

BACKGROUND OF THE INVENTION

Field of the Invention

This disclosure relates to a liquid discharge head and a method of manufacturing the same.

Description of the Related Art

In a liquid discharge head configured to discharge liquid such as ink from discharge ports, if liquid droplets remain in a vicinity of the discharge ports, deterioration of discharging property such as a change of a liquid discharging direction or lowering of a liquid discharge speed may occur. Therefore, a maintenance mechanism configured to wipe off a discharge port surface having discharge ports arrayed thereon regularly may be provided. In order to suppress liquid residues in the vicinity of the discharge ports and simplify the above-described maintenance mechanism, the discharge port surface can have a liquid repellent property.

PCT Japanese Translation Patent Publication No. 2007-518587 discloses a liquid discharge head having a discharge port surface formed of a liquid repellent property including hardener obtained from a condensation product of hydrolysable silane compound having fluorine content group with hydrolysable silane compound having cation polimerizable group.

SUMMARY OF THE INVENTION

This disclosure provides a liquid discharge head including a member provided with discharge ports configured to discharge liquid, wherein a discharge port surface of the member having the discharge ports arrayed thereon includes fumed silica.

This disclosure provides a method of manufacturing the liquid discharge head including discharge ports configured to discharge liquid, including:

forming a mold member on a substrate in an area which becomes a flow channel configured to introduce liquid to the discharge ports;

providing a member including fumed silica and having photosensitivity so as to cover the substrate and the mold member;

forming latent image of the discharge ports by performing exposure and baking on the member;

forming the discharge ports by developing an unexposed portion of the member;

forming a through hole penetrating through the substrate and reaching the mold member; and removing the mold member.

Further features of the present invention will become apparent from the following description of exemplary embodiments with reference to the attached drawings.

DESCRIPTION OF THE EMBODIMENTS

Figure 1:
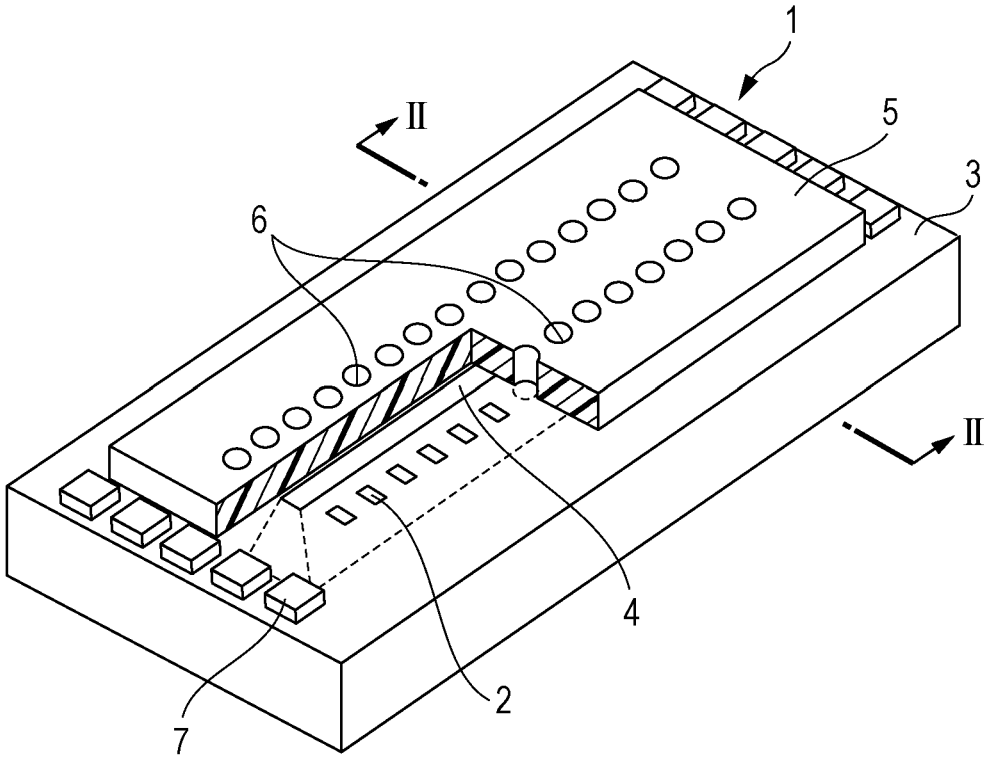
FIG. 1 is a perspective view illustrating a configuration of a liquid discharge head according to an embodiment of this disclosure.

Generally, a liquid repellent property as disclosed in PCT Japanese Translation Patent Publication No. 2007-518587 is not inexpensive. Therefore, a liquid discharge head disclosed in PCT Japanese Translation Patent Publication No. 2007-518587 has a problem of increase in manufacturing cost.

This disclosure provides a liquid discharge head having a liquid repellent property on a discharge port surface while suppressing an increase in manufacturing cost and a method of manufacturing the liquid discharge head.

Embodiments of the invention will be described below with reference to the drawings. The same configurations as in the respective drawings are denoted by the same reference numerals and description will be omitted.

FIG. 1 is a perspective view illustrating a configuration of a liquid discharge head 1 according to an embodiment of this disclosure.

The liquid discharge head 1 illustrated in FIG. 1 includes a substrate 3 provided with energy generating elements 2 generating energy for discharging liquid arranged in two rows at a predetermined pitch. The substrate 3 includes a supply channel 4, which is a through hole, formed between the two rows of the energy generating elements 2. The substrate 3 is provided with discharge ports 6 arrayed above the respective energy generating elements 2 and a flow channels configured to introduce the liquid to the respective discharge ports 6 from the supply channel 4 formed by a member 5. The substrate 3 is provided with terminals 7 formed at both ends thereof, and the liquid discharge head 1 is operated by a connection between the terminals 7 and an apparatus body on which the liquid discharge head 1 is mounted.

The liquid discharge head 1 is arranged so that a surface provided with the supply channel 4 faces a recording surface of a recording medium. By applying energy that the energy generating elements 2 generate (pressure, for example) to liquid filled in the flow channels from the supply channel 4, the liquid is discharged from the discharge ports 6 formed above the energy generating elements 2. In this configuration, recording is performed on the recording medium.

A method of manufacturing the liquid discharge head 1 will be described with reference to FIG. 2A to 2G. FIGS. 2A to 2G are cross-sectional views taken along the line II-II indicated in FIG. 1.

Figure 2A:
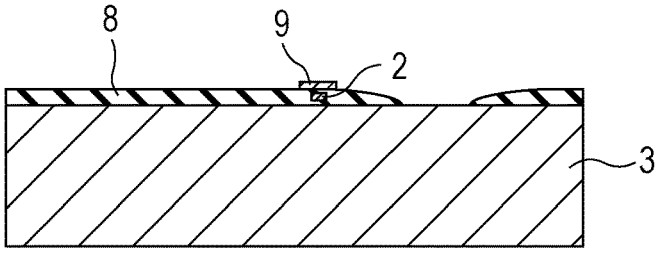
FIGS. 2A to 2G are drawings illustrating a method of manufacturing a liquid discharge head according to a first embodiment of this disclosure.

The substrate 3 having the energy generating elements 2 as illustrated in FIG. 2A, is prepared. Part of a surface of the substrate 3 is covered with a silicon nitride 8. A cavitation resistance film 9 is formed above the energy generating elements 2.

Figure 2B:
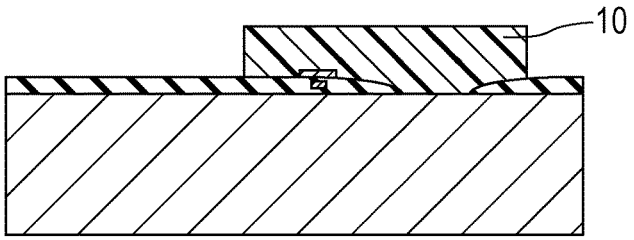

As illustrated in FIG. 2B, a mold member 10 is formed on the substrate, specifically, so as to cover a portion where the substrate 3 is exposed, the cavitation resistance film 9, and part of the silicon nitride 8. The mold member 10 is formed at a portion where the flow channels are formed.

Figure 2C:
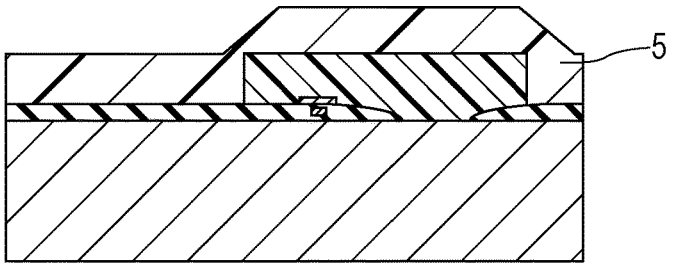

As illustrated in FIG. 2C, the member 5 including fumed silica is provided on the mold member 10 and the silicon nitride 8. The member 5 includes fumed silica and base material, and has a photosensitive property. The base material may be of any type as long as a discharge port surface having an intended liquid repellent property by adding fumed silica, and may be selected from various types of resin materials used for a discharge port forming member of the liquid discharge head. Acrylic resin or epoxy resin can be used as the resin material. A thickness of the member 5 is preferably selected from a range from 5 μm to 100 μm. Therefore, in the case where the member 5 is formed by using an application liquid, an amount of a base material resin material included in an application liquid is preferably within a range from 30 percent by mass to 80 percent by mass. An average particle diameter (primary average particle diameter, several averages) of fumed silica is preferably within a range from 1 nm to 20 nm, which gives no impact on a foaming property at edges of the discharge ports. The larger a relative surface area of fumed silica, the larger a lotus effect becomes. Therefore, the relative surface area is preferably within a range from 90 $m^2/g$ to 300 $m^2/g$.

A content of fumed silica in the member 5 may be an amount which provides the discharge port surface with an intended liquid repellent property (liquid repellent property in the case of aqueous ink). The content of fumed silica in the member 5 is preferably within a range from 5 percent by mass to 30 percent by mass. In an application liquid which is to be the member 5, the content of fumed silica is preferably within a range from 10 percent by mass to 50 percent by mass of the application liquid.

As described later, if the member 5 is configured to have a laminated structure having a plurality of layers, the content of fumed silica in an outermost layer can be set as described above.

Figure 2D:
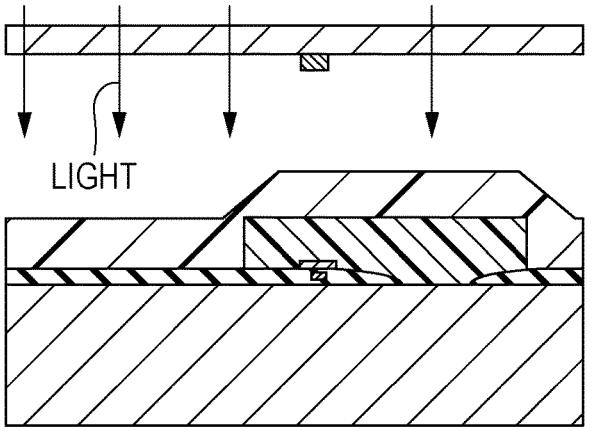

Subsequently, as illustrated in FIG. 2D, the member 5 is exposed via a mask so that a portion corresponding to the discharge ports 6 remains unexposed. Subsequently, baking is performed to form a latent image of the discharge ports 6.

Figure 2E:
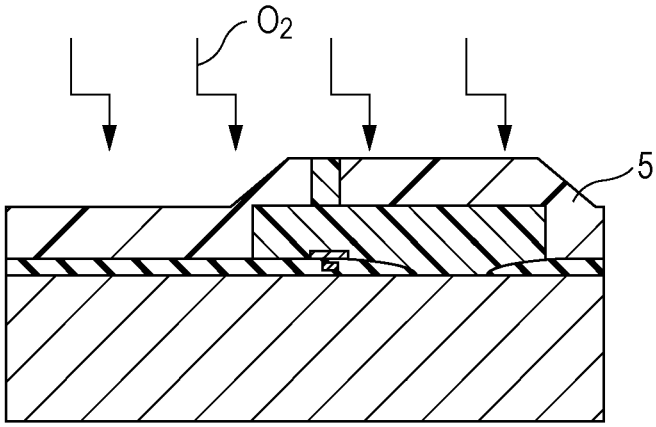

As illustrated in FIG. 2E, an oxygen plasma process is performed on the member 5 which is cured by being exposed and baked, and part of the surface of the member 5 is etched. The oxygen plasma does not etch fumed silica, irregularity of the surface of the member 5 is emphasized by and exposed portions of fumed silica particles, so that a higher liquid repellent property is achieved. Etching of the surface of the member 5 can be isotropic etching in order to further improve the performance. Fumed silica preferably exists in an area within 1 μm from the surface of the member 5.

Figure 2F:
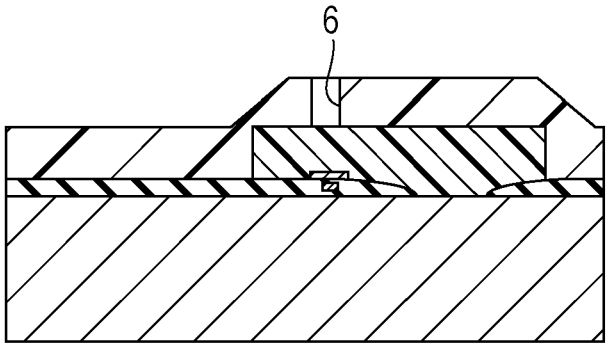

As illustrated in FIG. 2F, the unexposed portion is developed to form the discharge ports 6. In this manner the discharge ports 6 is formed of the member 5 including fumed silica. Therefore, the discharge port surface on which the discharge ports 6 are arrayed has a liquid repellent property.

Figure 2G:
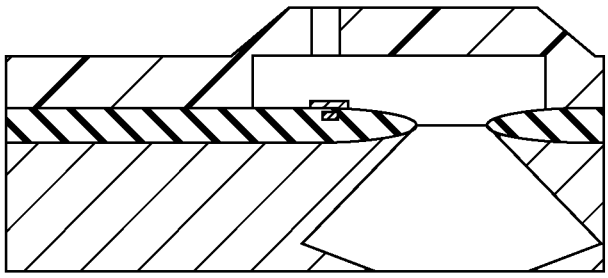

Subsequently, the surface of the member 5 is protected by a surface protecting layer, and, as illustrated in FIG. 2G, the through hole, which served as the supply channel 4 reaching the mold member 10 is formed on the substrate 3, and then the surface protecting layer and the mold member 10 are removed.

After the process described above, the substrate 3 is separated and cut into chips by using a dicing sew and the like. Subsequently, an electric joint for driving the energy generating elements 2 and connection of a chip tank member for supplying liquid are performed to manufacture a principal portion of the liquid discharge head.

This disclosure will be described in detail with reference to examples below.

FIRST EXAMPLE

A method of manufacturing a liquid discharge head of a first example is the same as a method of manufacturing descried with reference to FIG. 2A to 2G.

In the first example, a positive resist ODUR1010 (name of product) manufactured by TOKYO OHKA KOGYO CO., LTD. was used as a mold member 10. After the ODUR1010 had been applied by a film thickness of 14 μm, exposure was performed by using a Proximity Exposing Machine manufactured by USHIO Inc. to form the mold member 10.

Subsequently, an application liquid for forming a member 5 which was a mixture of fumed silica and a base material mixed so that a ratio of fumed silica which occupies a solid component contained in the application liquid had 15 percent by mass was applied to the mold member 10 and a silicon nitride 8 (FIG. 2C). R976S (name of product) manufactured by NIPPON AEROSIL CO., LTD. was used as fumed silica. Fumed silica in this product had an average particle diameter of 7 nm and a relative surface area of 300 $m^2/g$. As the base material, an epoxy resin, which was a negative photosensitive resin, was used as a material for discharge ports forming member of the liquid discharge head. SU-8 3000 (product name) manufactured by Nippon Kayaku Co., Ltd. was used as an application liquid in which photo initiator and epoxy resin are added was used and fumed silica was added to the application liquid by 15 percent by mass.

After the member 5 has been exposed by using Stepper manufactured by CANON Inc., the member 5 was baked to form a latent image of discharge ports 6 (See FIG. 2D). Subsequently, Dry Etcher CDE-7-4 manufactured by Shibaura Mechatronics Corporation was used, oxygen plasma is applied to the member 5 cured by exposure and baking, and etching up to a depth of approximately 0.5 μm is performed on the member 5 from a front surface side thereof (FIG. 2E). After the oxygen plasma process has terminated, the unexposed portion was developed to form the discharge ports (FIG. 2F). After the discharge ports 6 had been formed, a through hole, which served as the supply channel 4 was formed on a substrate 3 and the mold member 10 or the like was removed, whereby a principal portion of the liquid discharge head 1 was manufactured.

SECOND EXAMPLE

In a second example of this disclosure, the member 5 that forms the discharge ports 6 are formed in two layers. A method of manufacturing a liquid discharge head of the second example will be described below with reference to FIG. 3A to 3D. Although the process of forming the mold member 10 is the same as the first example, description will be omitted.

Figure 3A:
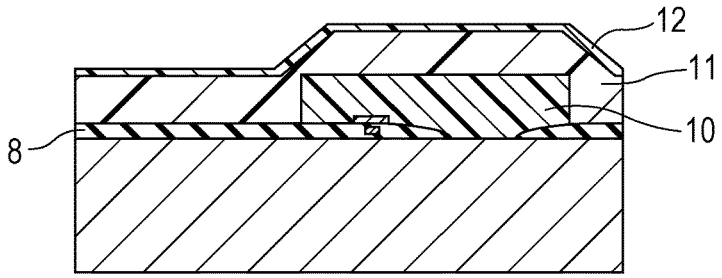
FIGS. 3A to 3D are drawings illustrating a method of manufacturing a liquid discharge head according to a second embodiment of this disclosure.
Figure 3B:
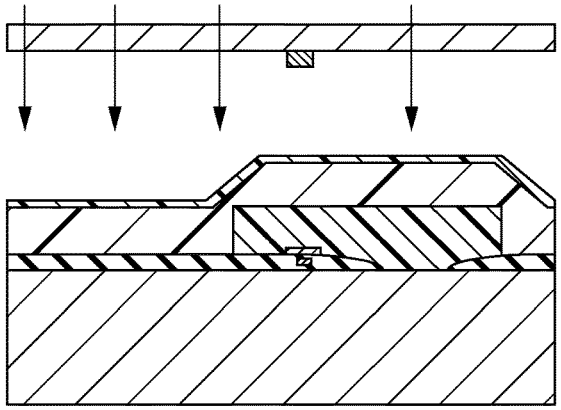

After the mold member 10 had been formed, a lower layer member 11 was provided on the mold member 10 and the silicon nitride 8, and an upper layer member 12 was provided on the lower layer member 11 as illustrated in FIG. 3A. The lower layer member 11 was formed by using an application liquid prepared by mixing photo initiator to an epoxy resin, which was a negative photosensitive resin, was used as a material for the discharge ports forming member of the liquid discharge head.

Fumed silica (R976S (name of product) manufactured by NIPPON AEROSIL CO., LTD.) corresponding to a solid content of 16 percent by mass was mixed with epoxy resin solution having a concentration corresponding to a solid content of 8 percent by mass used for the discharge port forming member of the liquid discharge head, and the solution was diluted with solution by 50% to prepare an application liquid. The upper layer member 12 was formed by using this application liquid. The upper layer member 12 obtained in this manner had a liquid repellent property.

The application liquid for forming the lower layer member 11 was applied to the mold member 10 and the silicon nitride 8, and is cured by baking. In the second example, the application liquid for forming the lower layer member 11 was applied so that the film thickness after baking becomes 25 μm. The application liquid for forming the upper layer member 12 was applied to the upper layer member 12 so that the film thickness becomes 1 μm. At this time, a slit application was performed in order to avoid the application liquid for forming the upper layer member 12 from melting the lower layer member 11.

Figure 3C:
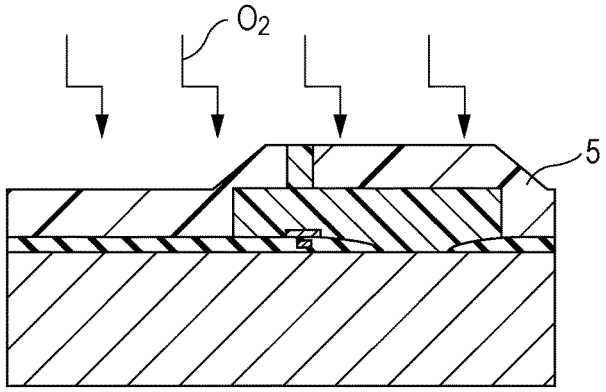
Figure 3D:
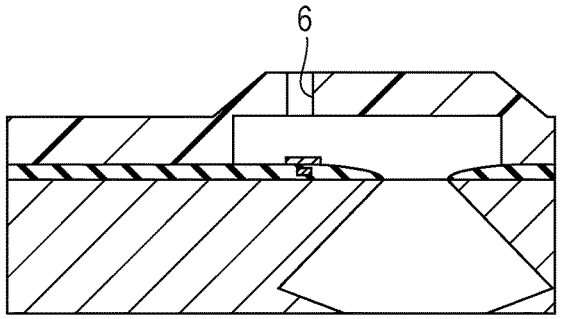

After the lower layer member 11 and the upper layer member 12 have been stacked, exposure and baking were performed by using Stepper manufactured by CANON Inc. (FIG. 3B) to form a latent image of the discharge ports 6. Subsequently, Dry Etcher CDE-7-4 manufactured by Shibaura Mechatronics Corporation was used, oxygen plasma is applied to the member 5 formed of the lower layer member 11 and the upper layer member 12 by being cured by exposure and baking. With the plasma process, the surface of the cured member 5 is etched up to a depth of approximately 0.5 μm (FIG. 3C). After that, the unexposed portion was developed to form the discharge ports 6. After the discharge ports 6 had been formed, a through hole, which served as the supply channel 4 was formed on the substrate 3 and the mold member 10 or the like was removed, whereby a principal portion of the liquid discharge head 1 was manufactured.

In the second example, the upper layer member 12 including fumed silica is arranged as a top layer, and the surface formed of a cured upper layer member 12 corresponds to a discharge port surface. Therefore, the discharge port surface of the cured member 5 has a liquid repellent property.

THIRD EXAMPLE

FIGS. 4A to 4H are drawings illustrating a method of manufacturing a liquid discharge head 1 according to a third example of this disclosure.

Figure 4A:
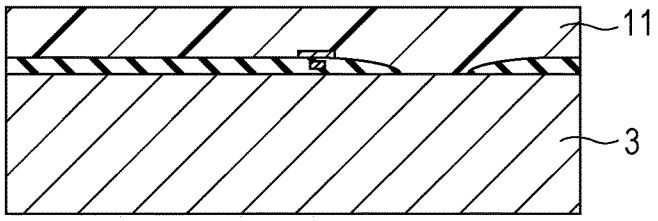
FIGS. 4A to 4H are drawings illustrating a method of manufacturing a liquid discharge head according to a third embodiment of this disclosure.

As illustrated in FIG. 4A, the lower layer member 11 which corresponds to a flow channel wall was formed on the substrate 3. Specifically, the lower layer member 11 which was turned into a dry film by using the application liquid used in the second example was prepared and was transferred to the substrate 3. In the third example, the film thickness of the lower layer member 11 was 14 μm.

Figure 4B:
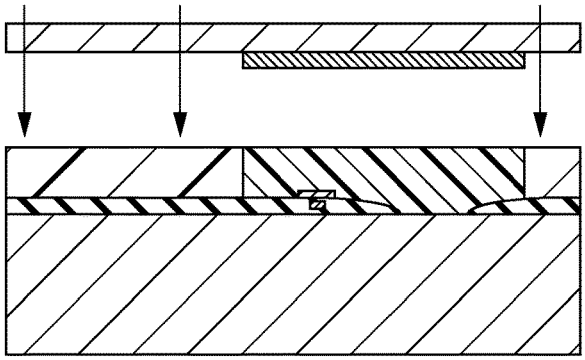
Figure 4C:
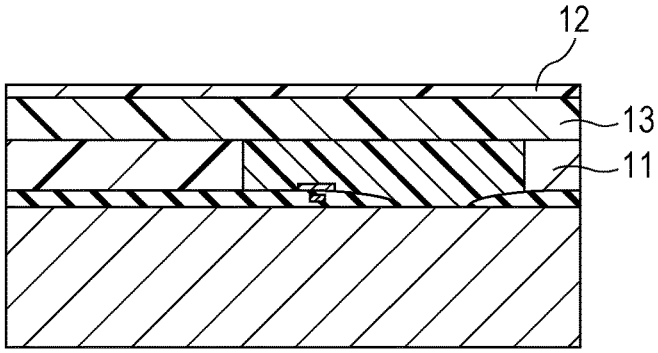

Subsequently, as illustrated in FIG. 4B, the lower layer member 11 was exposed via a mask so that a portion corresponding to a flow channel remains unexposed. Subsequently, baking is performed to form a latent image of the flow channel. Subsequently, as illustrated in FIG. 4C, an intermediate layer member 13 was formed on the lower layer member 11, and the upper layer member 12 was formed on the intermediate layer member 13. The intermediate layer member 13 was manufactured by adjusting an amount of a photo initiator so as to have a sensitivity which is one tenth of the lower layer member 11. Subsequently, the dry film of the intermediate layer member 13 having the film thickness of 11 μm was prepared by using the application liquid used in the second example and transferred to the lower layer member 11 under vacuum. Subsequently, the upper layer member 12 was formed on the intermediate layer member 13 by an application method in the same manner as the second example.

Figure 4D:
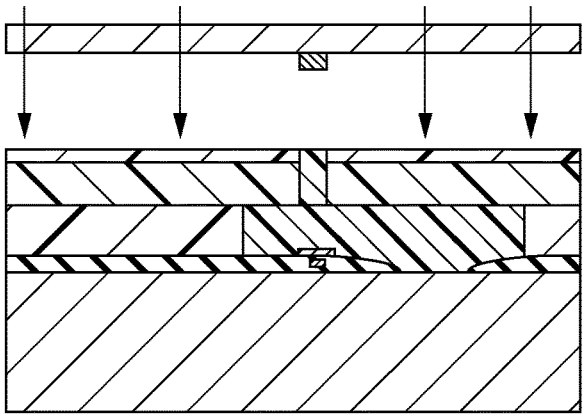
Figure 4E:
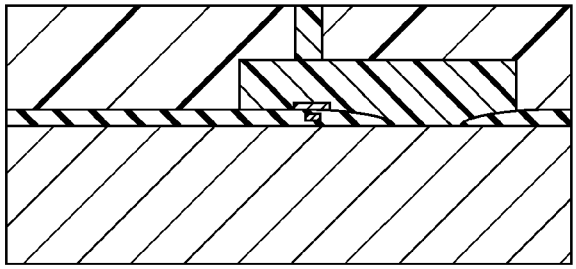

As illustrated in FIG. 4D, the upper layer member 12 and the intermediate layer member 13 were exposed and baked via a mask so that a portion which corresponds to the discharge ports 6 was remained unexposed, so that a latent image of the discharge ports 6 was formed as illustrated in FIG. 4E.

Figure 4F:
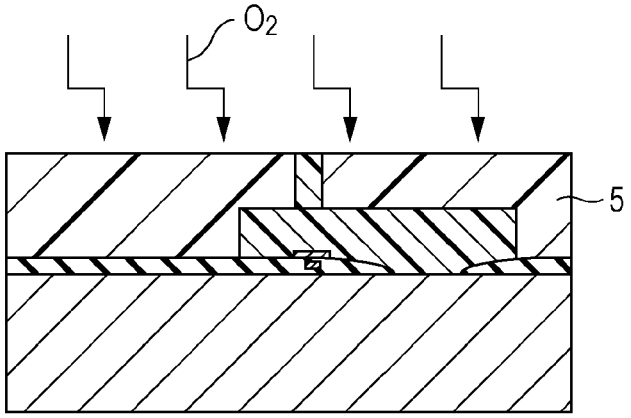

Subsequently, as illustrated in FIG. 4F, Dry Etcher CDE-7-4 manufactured by Shibaura Mechatronics Corporation was used, oxygen plasma was applied to the member 5 formed of the lower layer member 11, the intermediate layer member 13, and the upper layer member 12 by being cured by exposure and baking. With the plasma process, the surface of the cured member 5 is etched up to a depth of approximately 0.5 μm.

Figure 4G:
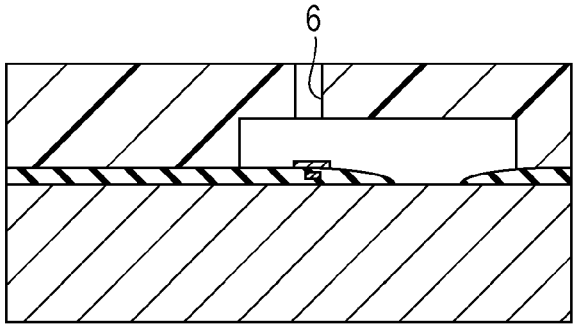

As illustrated in FIG. 4G, the unexposed portion is developed to form the discharge ports 6 and the flow channel.

Figure 4H:
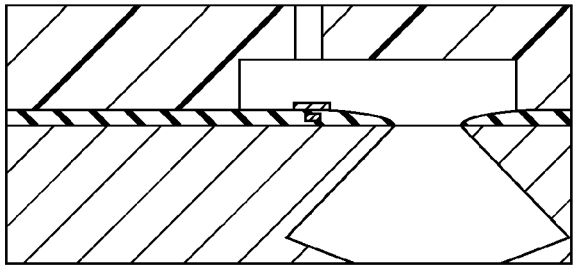

Subsequently, the surface of the cured member 5 is protected by a surface protecting member and, as illustrated in FIG. 4H, the through hole communicating with the flow channel and serving as the supply channel 4 was formed on the substrate 3, and then the surface protecting member was removed.

After the process described above, the substrate 3 is separated and cut into chips by using a dicing sew and the like. Subsequently, an electric joint for driving the energy generating elements 2 and connection of a chip tank member for supplying liquid are performed to manufacture a principal portion 1 of the liquid discharge head.

In the second example, the upper layer member 12 including fumed silica is arranged as a top layer, and the surface formed of a cured upper layer member 12 corresponds to the discharge port surface. Therefore, the discharge port surface of the cured member 5 has a liquid repellent property.

As a result of verification of specific characteristics of the liquid discharge head formed by a method of manufacturing described in conjunction with the first to third examples described above, it was verified that the discharging performance required in a recording apparatus having the liquid discharge head mounted thereof was satisfied.

In this manner, in the third example, the liquid discharge head 1 is provided with the member 5 having the discharge ports 6 formed thereon, and the discharge port surface of the member 5 having the discharge ports arrayed thereon includes fumed silica.

Since the discharge port surface is formed to include the fumed silica having the liquid repellent property, and hence has the liquid repellent property. Since fumed silica is relatively inexpensive, the discharge port surface having the liquid repellent property may be provided while suppressing an increase in manufacturing cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-176785 filed Sep. 1, 2014, which is hereby incorporated by reference herein in its entirety.

What is claimed is:

1. A liquid discharge head comprising:

a substrate; and a member provided with discharge ports, the liquid discharge head configured to discharge liquid, wherein a discharge port surface of the member having the discharge ports arrayed thereon includes fumed silica, the fumed silica has an average particle diameter not larger than 20 nm, and a relative surface area of not smaller than 90 $m^2/g$, and the member comprises an epoxy resin.

2. The liquid discharge head according to claim 1, wherein the fumed silica has the relative surface area of not larger than 300 $m^2/g$.

3. The liquid discharge head according to claim 1, wherein a content of the fumed silica in the member is within a range from 5 percent by mass to 30 percent by mass.

4. The liquid discharge head according to claim 1, wherein a surface of the member is etched until a surface of the fumed silica is exposed, and the surface of the member is irregular due to the fumed silica.

5. The liquid discharge head according to claim 1, wherein the fumed silica exists in an area within 1 μm from a surface of the member.

* * * * *